US009989244B2

(12) United States Patent
Maryamchik et al.

(10) Patent No.: US 9,989,244 B2
(45) Date of Patent: Jun. 5, 2018

(54) FURNACE COOLING BY STEAM AND AIR INJECTION

(71) Applicant: The Babcock & Wilcox Company, Barberton, OH (US)

(72) Inventors: Mikhail Maryamchik, Fairlawn, OH (US); Michael J Szmania, Medina, OH (US); Donald L Wietzke, Carlsbad, CA (US)

(73) Assignee: The Babcock & Wilcox Company, Barberton, OH (US)

( * ) Notice: Subject to any disclaimer, the term of this patent is extended or adjusted under 35 U.S.C. 154(b) by 340 days.

(21) Appl. No.: 15/057,345

(22) Filed: Mar. 1, 2016

(65) Prior Publication Data

US 2017/0254529 A1 Sep. 7, 2017

(51) Int. Cl.

| | |
|---|---|
| ***F22B 37/44*** | (2006.01) |
| ***F22D 11/00*** | (2006.01) |
| ***F22D 5/26*** | (2006.01) |

(52) U.S. Cl.

CPC ..... *F22D 11/003* (2013.01); *F22B 37/44* (2013.01); *F22D 5/26* (2013.01)

(58) Field of Classification Search

CPC ..... F22D 11/003; F22D 5/26; F22B 37/44
See application file for complete search history.

(56) References Cited

U.S. PATENT DOCUMENTS

| | | | | | |
|---|---|---|---|---|---|
| 4,992,085 | A * | 2/1991 | Belin | B01D 45/08 | 110/216 |
| 5,343,830 | A * | 9/1994 | Alexander | F22B 31/0084 | 110/245 |
| 5,378,253 | A * | 1/1995 | Daum | B01D 45/08 | 122/4 D |
| 5,809,940 | A * | 9/1998 | James | B01D 45/08 | 110/245 |
| 6,095,095 | A * | 8/2000 | Alexander | B01D 45/08 | 110/245 |
| 6,269,778 | B1 * | 8/2001 | Anderson | F27B 15/12 | 110/245 |
| 6,322,603 | B1 * | 11/2001 | Walker | B01D 45/08 | 110/216 |
| 2003/0202913 | A1 * | 10/2003 | Maryamchik | B01D 45/12 | 422/147 |
| 2007/0283902 | A1 * | 12/2007 | Maryamchik | F23C 10/18 | 122/4 D |

* cited by examiner

*Primary Examiner* — Nathaniel Herzfeld
(74) *Attorney, Agent, or Firm* — Michael J. Seymour

(57) ABSTRACT

A system can quickly cool and de-pressurize a boiler arrangement under non-normal operating conditions such as loss of plant power. A discharge system injects into the furnace a combined stream of steam from a steam discharge system and ambient air, thereby both cooling components of the boiler arrangement and reducing pressure in the steam/water circuit. This reduces or eliminates the additional cost associated with providing extra capacity in a steam drum and/or an independently powered boiler water pump. The system is particularly useful for quickly cooling the U-beams of a circulating fluidized bed boiler during a black plant condition.

20 Claims, 3 Drawing Sheets

FURNACE COOLING BY STEAM AND AIR INJECTION

BACKGROUND INFORMATION

Circulating fluidized bed (CFB) boilers are used in the production of steam for industrial processes and electric power generation; see, for example, U.S. Pat. Nos. 5,799,593, 4,992,085, 4,891,052, 5,343,830, 5,378,253, 5,435,820, and 5,809,940. For an overview of the design and operation of CFB boilers, see *Steam: Its Generation and Use,* 41st ed., Chapter 17 (2005; The Babcock & Wilcox Company, Barberton, Ohio) and *Steam: Its Generation and Use,* 42nd ed., Chapter 17 (2015; The Babcock & Wilcox Company, Barberton, Ohio).

In a CFB boiler, upward gas flow carries reacting and non-reacting solids to an outlet at the upper portion of the furnace where the solids are separated from the gas, typically by a staggered array of impact-type particle separators. The gaseous components of the stream navigate around the separator unit, while the entrained solids deflect and return to the furnace bottom. Impact-type particle separators, which generally are not cooled, protect the downstream heating surfaces, such as those of primary and secondary superheaters, from erosion by solid particles.

While such separators can have a variety of configurations, a common version involves so-called U-beams, individual impingement members having U-shaped cross sections.

Because of the extremely high temperatures experienced at a furnace outlet, the materials from which particle separator components, such as U-beams, are made must be sufficiently temperature resistant to provide adequate support and resist damage. Some impact-type particle separators are cooled or supported off a cooled structure; see, for example, U.S. Pat. Nos. 6,322,603, 6,454,824, and 6,500,221.

A representation of a commercially available CFB boiler with impact-type separator is shown in FIGS. 1, 2 and 2A. Furnace 10 has a gas-tight enclosure 11 suitable for operating with a positive pressure in furnace 10 and a flue gas flow path 15. Primary air enters furnace 10 through windbox 80 and distribution grid 90 (also known as a distributor plate), and, downstream thereof, secondary air is injected through upper and lower overfire air headers. Fuel and sorbent are fed to the CFB bed through the lower walls of furnace 10, with ash and spent sorbent being removed through drain pipes in the floor. The primary solids separation system, generally designated 30, includes staggered rows of U-shaped channel members, i.e., primary particle separator U-beams 32 and in-furnace U-beams 34, suspended from the roof or other pressure parts of the unit. Solids collected by U-beams 32, 34 and multi-cyclone dust collector are returned through the rear wall to the lower portion of furnace 10.

Situations where a plant loses power, sometimes referred to as a "black plant" condition, call for procedures and equipment which permit boiler pressure to decay and boiler temperature to cool to stable conditions as quickly as practical, all without allowing the water level to drop below the furnace roof. Typically, a main steam stop valve (MSV) closes to prevent rapid pressure reduction in the steam/water side and dropping of the water level in the boiler. Thermal inertia in the drum, tubes, headers and other boiler components continues to generate steam after the MSV closing, however. Opening of a steam relief valve prevents steam pressure buildup, which can trigger a safety valve opening with a corresponding rapid water level drop in the boiler and can provide cooling of superheater surface subjected to residual heat of the uncooled parts of the boiler components, such as a U-beam solids separator. The opened valve allows steam to bleed through the steam side of the superheater into the atmosphere or to the steam user (when the steam is used for heating), typically in a controlled manner.

Such steam bleed lowers the water level in the boiler circulation system, however. If the water level recedes below the furnace roof, portions of the tubes become uncooled, and the residual heat of the uncooled parts of the solids separator can damage the uncooled tube portions. To prevent such damage by maintaining a safe water level in the boiler, the boiler can be provided with sufficient steam drum capacity and/or an independently powered boiler water pump, also known as a dribble pump. Both of these increase boiler cost, however.

An attempt to ameliorate these additional costs is described in U.S. Pat. No. 8,047,162, where steam bleed is controllably discharged into the boiler furnace. The steam bleed temperature typically is on the order of 400° to 600° C. (750° to 1100° F.) lower than that of the uncooled parts of the solids separator, so introduction of steam into the solids/gas flow path accelerates the cooling of (potentially) uncooled tubes in the vicinity to a safe temperature (~500° C.). This solution can reduce the amount of the extra steam drum capacity, but it does not usually altogether eliminate the need for additional capacity nor for the independently powered boiler water pump.

SUMMARY

The processes, systems and equipment described herein can protect power generation devices and their components against thermal damage due to abnormal operating conditions, while reducing or altogether avoiding the additional costs associated with providing steam drums with additional capacity and/or an independently powered boiler water pump.

Advantageously, the cooling of boiler components, such as U-beams and associated support structures, is accomplished with a simultaneous reduction in boiler pressure.

In one aspect is provided a CFB boiler arrangement that includes a furnace, a solids separator system, a steam transporting circuit, and at least one secondary air inlet mechanism adapted to introduce into the CFB boiler furnace steam and air when needed (e.g., during abnormal operating conditions such as a black plant trip). The introduced stream of steam and air can accelerate cooling of solids separator system, which in turn can reduce or eliminate the cost of means necessary to prevent damage to uncooled boiler tubes, such as additional drum capacity and/or an independently powered boiler water pump.

In the CFB boiler arrangement, steam for injection can be obtained from an attemperator inlet header, the steam drum, or any other point in the steam circuit. The steam circuit optionally also can include a pressure reducing station connected to a steam supply line.

The CFB boiler arrangement optionally can include a dribble pump connected to a steam drum in the steam circuit to maintain water flow to the steam drum, thereby offsetting steam lost from the steam circuit due to injection into the furnace.

In yet another aspect of the present invention is a circulating fluidized bed boiler arrangement that comprises a furnace with at least one primary air inlet and one or more secondary air inlets, a solids separator system, a steam/water circuit for circulating steam and water, and a steam discharge system, a system for cooling components of said boiler arrangement during abnormal operating conditions comprising: a) at least one of said one or more secondary air inlets comprising a valve which, in an opened conditions, permits ingress of air external to said boiler arrangement; b) conduit for conveying steam out of and away from the steam discharge circuit, said conduit providing ingress to said at least one secondary air inlet; and c) in or associated with said secondary air inlet, an eductor in communication with said steam conveyance conduit, said eductor being capable of outputting a combined stream of said external air and said conveyed steam to said furnace during abnormal operating conditions.

Also provided is a method for cooling hot components of a boiler arrangement that includes a boiler enclosure defining a gas flow path for transporting flue gas during normal operation. The method finds particular utility in connection with boiler parts such as impact-type particle separator components, particularly during abnormal operation conditions such as a black plant trip. The method includes providing a source of steam and discharging a combined stream of the steam and ambient air into the gas flow path, thereby cooling the hot boiler components.

The method optionally can involve monitoring the temperature of one or more of the components and continuing the steam/air discharge step until the temperature of the component(s) in the vicinity is safe, typically ~450° to ~480° C. (850° to 900° F.).

In yet another aspect of the present invention is a method for facilitating the cooling of components of a circulating fluidized bed boiler arrangement that comprises (1) a furnace with at least one primary air inlet and one or more secondary air inlets, wherein at least one of said one or more secondary air inlets is adapted to communicate with an air valve and encloses an eductor, (2) a solids separator system and (3) a steam/water circuit for circulating steam and water, said method comprising: a) conveying steam out of and away from said steam/water circuit to said eductor; and b) allowing said eductor to combine said steam with air introduced through said air valve, said air originating from a source external to said boiler arrangement; and c) introducing said combined stream into said furnace, thereby reducing the internal temperature of said furnace and helping to cool said components.

Steam itself, with a typical temperature range of ~150° to ~400° C. (300° to 750° F.), is substantially cooler than the temperature of uncooled boiler parts such as components of a solids separating unit, typically ~750° to ~925° C. (1400° to 1700° F.). Nevertheless, ambient air has a temperature that is substantially lower than that of steam. Thus, a combined discharge of steam and air into the furnace of a boiler significantly reduces the amount of time needed to cool boiler parts, e.g., solids separating unit components, to a temperature level considered safe in view of the materials of components (such as tubes) in the vicinity.

The preceding non-limiting aspects, as well as others, are more particularly described below. A more complete understanding of the processes and equipment can be obtained by reference to the accompanying drawings, which are not intended to indicate relative size and dimensions of the assemblies or components thereof. In those drawings and the description below, like numeric designations refer to components of like function. Specific terms used in that description are intended to refer only to the particular structure of the embodiments selected for illustration in the drawings, and are not intended to define or limit the scope of the disclosure.

BRIEF DESCRIPTION OF THE DRAWINGS

The embodiments disclosed herein may take form in various components and arrangements of components, and in various process operations and arrangements of process operations. The drawings are only for purposes of illustrating preferred embodiments and are not to be construed as limiting. The foregoing and other aspects will become apparent to those skilled in the art to which the present examples relate upon reading the following description with reference to the accompanying drawings, in which.

DETAILED DESCRIPTION

Figure 1:
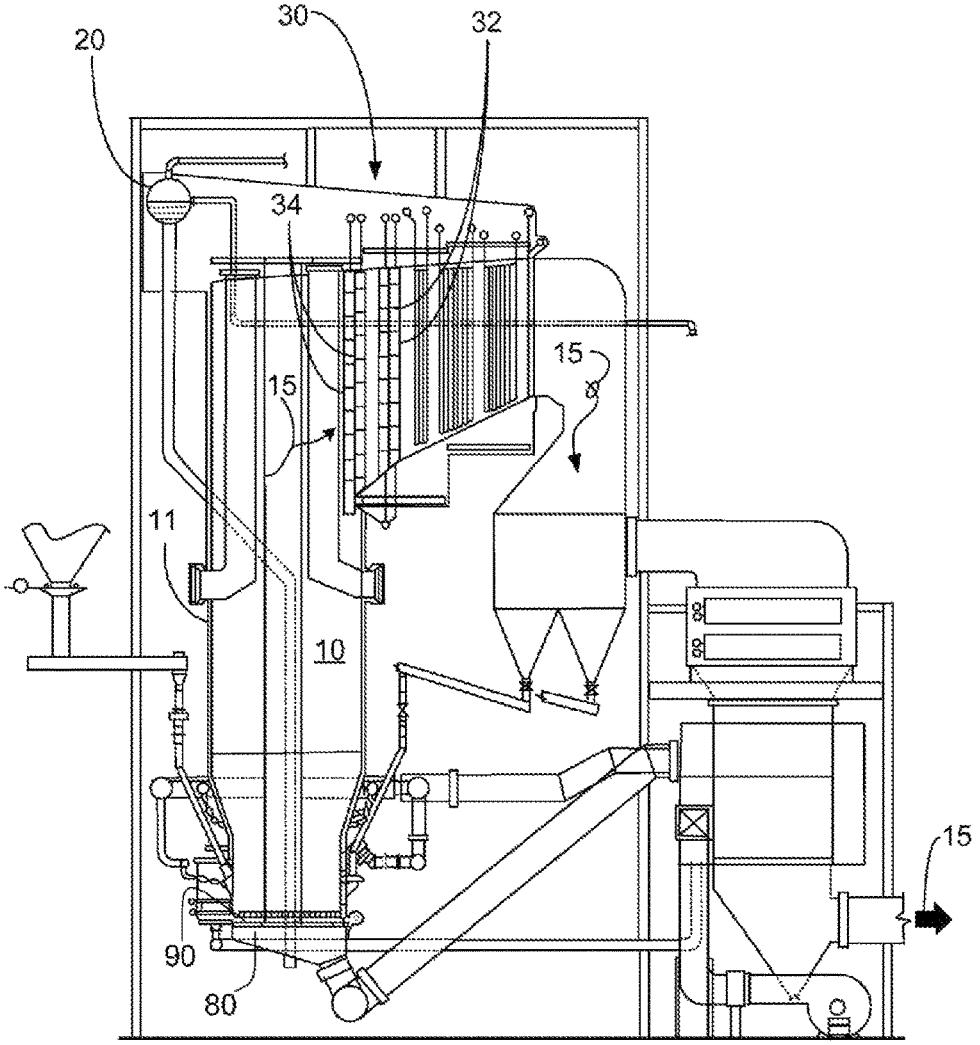
FIG. 1 PRIOR ART
FIG. 1 is a schematic representation of a CFB boiler arrangement of the prior art.

A more complete understanding of the components, processes, systems, methods and apparatuses disclosed herein can be obtained by reference to the accompanying drawings. The figures are merely schematic representations based on convenience and the ease of demonstrating the present disclosure, and is, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification, various devices and parts may be described as "comprising" other components. The terms "comprise(s)," "include(s)," "having," "has," "can," "contain(s)," and variants thereof, as used herein, are intended to be open-ended transitional phrases, terms, or words that do not preclude the possibility of additional components.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" should also be considered as disclosing the range defined by the absolute values of the two endpoints. For example, the expression "from about 2 to about 4 also discloses the range "from 2 to 4."

To the extent that explanations of certain terminology or principles of the fluidized bed arts, systems, processes, and related arts may be necessary to understand the present disclosure, the reader is referred to Steam/its generation and use, 40th Edition, Stultz and Kitto, Eds., Copyright 1992, The Babcock & Wilcox Company, and to Steam/its generation and use, 41st Edition, Kitto and Stultz, Eds., Copyright 2005, The Babcock & Wilcox Company, and Steam/its generation and use, 42nd Edition, G. L. Tomei, Ed., Copyright 2015, The Babcock & Wilcox Company, the texts of which are hereby incorporated by reference as though fully set forth herein.

While not intended to be limiting, the following description is based in large part on possible operation of equipment during abnormal operating conditions, such as those which occur during a black plant trip.

Unless the surrounding text explicitly indicates a contrary intention, any value given in the form of a percentage in connection with a gaseous stream, input or product is a volume percentage (v/v), while all other values given in the form of percentages are weight percentages (w/w).

The word about and "~" symbol, when used in connection with a number, has the meaning dictated by the surrounding context and includes the number itself as well as at least the degree of error commonly associated with measurements of the particular quantity in question.

The terms "downstream" and "upstream" refer to spatial relationships based on where combustion gases are generated, with the area of primary generation being considered as the most upstream point.

While the components and operation of a CFB boiler have been known for some time and are more fully described in one or more of the patents mentioned previously, a brief overview is provided below to assist in the understanding of the articles and processes of the invention.

Figure 3:
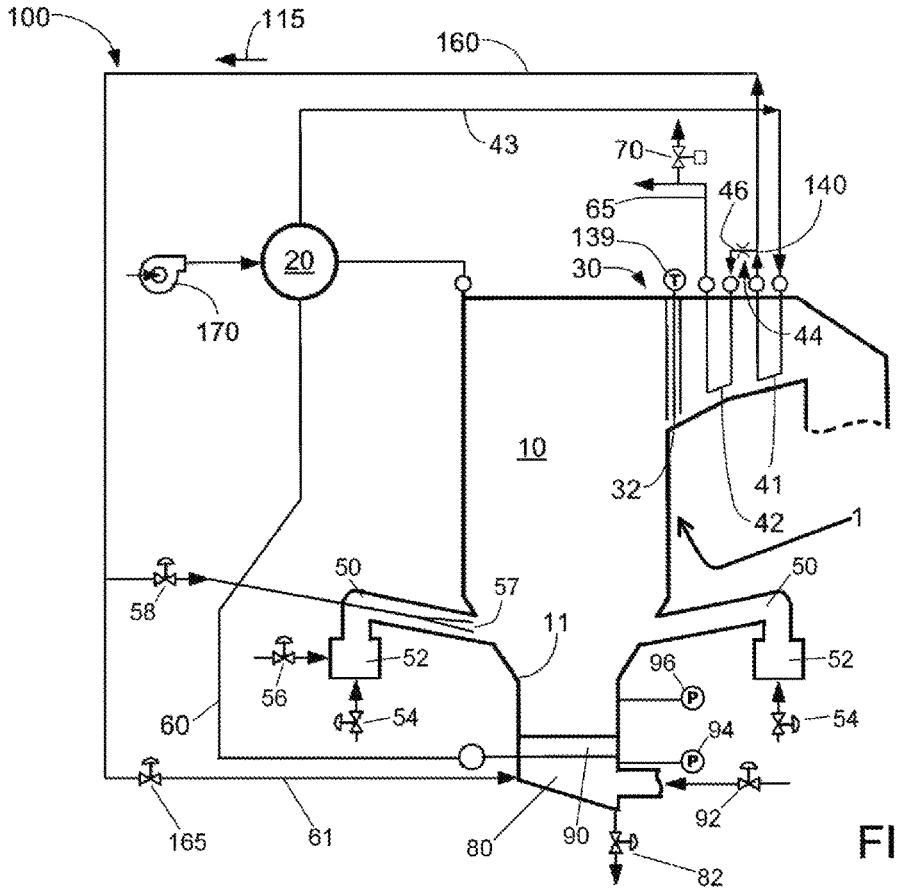
FIG. 3 is a schematic representation of a CFB boiler arrangement adapted to inject, when needed in view of plant operating conditions, a combined stream of steam and ambient air into a boiler.

Referring to FIG. 3, CFB boiler arrangement 1 includes furnace 10 which is supplied with primary air through windbox 80 and distribution grid 90, flow thereof being controlled by valve 92, and with secondary air through headers 52 and nozzles 50, flow thereof being controlled by valves 54. The two points of secondary air introduction shown in FIG. 3 is exemplary and not limiting. The shape and mechanism of operation of headers 52 and nozzles 50, as well as the source of the air introduced by valves 54, likewise can vary widely.

The header associated with any nozzle 50 in which is situated an eductor 57 (discussed in more detail below) is equipped with at least one valve 56 which can be remotely controlled so as to connect that header to a source of ambient air located external to CFB boiler arrangement 1.

Gases and solid products of combustion occurring in furnace 10 move upwardly (downstream), away from locations where primary and secondary air are introduced. Gases pass through to primary and secondary superheaters 41 and 42, where they act to superheat steam flowing therethrough, and beyond.

Solid components are removed by impact-type separators 32 (U-beams) which serve to protect downstream heating surfaces from erosion. Such solids are collected and recycled back to furnace 10. U-beams 32 can be equipped with a temperature sensor, designated 139 in FIG. 3, which assists in monitoring the temperature of U-beams, as discussed in more detail below. Temperature sensor 139 is adapted to output, or used in combination with devices capable of outputting, data that can be read or monitored remotely.

CFB boiler arrangement 1 also includes steam delivery path 43 and steam discharge system 100, which includes steam bleed line 160 for transporting steam 115 from a steam source located at any point in the boiler steam path of steam/water circuit 60, starting with steam drum 20 or preferably, and as shown in FIG. 3, attemperator inlet header 140 associated with attemperator 46, a device which reduces and controls the temperature of a superheated fluid passing therethrough by, for example, spraying high purity water 44 into an interconnecting steam pipe, usually between superheaters 41 and 42. Steam discharge system 100 also includes line 61 connected to windbox 80 as well as valve 165, which preferably can be controlled remotely so as to permit introduction of steam 115 into windbox 80 via line 61 when needed or desired, as more fully described below.

After an abnormal operating event such as a black plant trip, several events occur, either by default or by design.

Figure 2A:
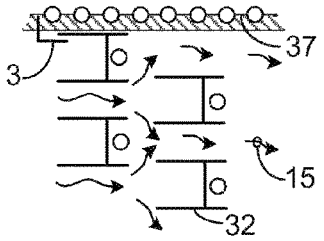
FIG. 2A PRIOR ART
FIGS. 2 and 2A are schematic illustrations of the upper portion of the CFB boiler of FIG. 1.
Figure 2:
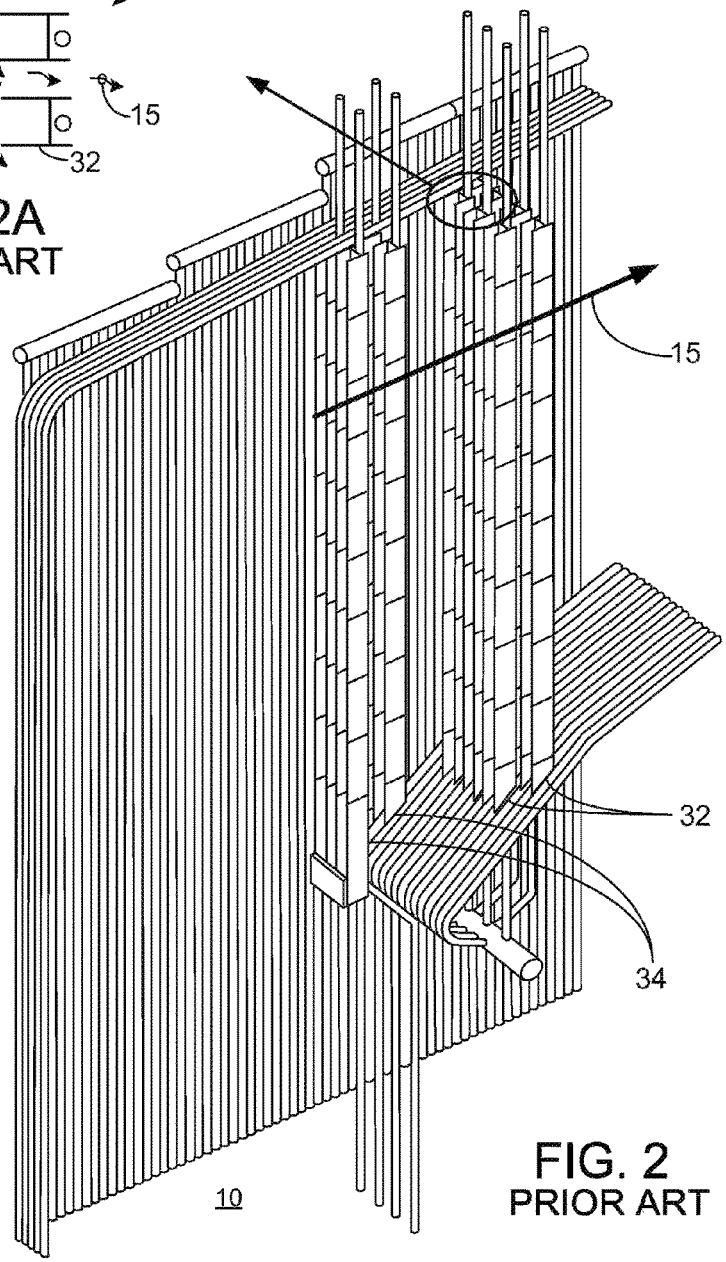
FIG. 2 PRIOR ART

For example, the aforementioned solids generally collapse to the floor of furnace 10. These solids are initially at the bed operating temperature just prior to the interrupting event and continue to transfer heat to the lower walls of furnace 10 and generate steam for some time. With MSVs closed, the additional steam generation, if not controlled, leads to lifting one or more of the safety valves on main steam outlet 65 and drum 20. Corresponding massive loss of steam results in a rapid drop of the boiler water level, which presents the risk of the water level going below the furnace roof In an abnormal operating situation such as a black plant trip, U-beams 32 represent a significant thermal storage mass which continues to radiate heat to surrounding areas for an extended period of time. Specifically, water-cooled U-beam/rear wall support tubes 37 (see FIG. 2A) continue to receive heat from U-beams 32 at an elevated temperature similar to that from normal boiler operation. As long as these tubes contain water, they maintain acceptable temperatures and stress values. However, if the water level falls below the furnace roof, some portion of these tubes may have only steam cooling, and the temperature of the tube metal quickly rises. Even though low alloy steel tubes typically are used for the U-beam and rear wall support tubes 37, shown as SW membrane panel in FIG. 2A (with ability to maintain normal operation stress levels to temperatures over normal working temperature), loss of water in the tubes while U-beams 32 are still near their normal operating temperature can result in a tube temperature where the normal operation stress in the tube exceeds its allowable stress at that temperature.

A number of actions or steps, which can occur in series, in parallel or some combination thereof, are envisioned to counter the conditions that lead to rapid water loss to below the furnace roof.

Controlled venting of steam 115, into furnace 10 alone or to furnace 10 and the atmosphere, can be undertaken as required to suppress pressure rise and reduce the chance of safety valves being lifted.

For example, 5-10% boiler maximum continuous rating (BMCR) steam flow can be vented through injection headers and nozzles (not shown) of steam discharge/injection system 100, described above, which helps cool U-beams 32.

Further, the pressure rise at main steam outlet 65 can be monitored, as is known in the art, with opening of power operated vent 70 occurring if pressure continues to rise and approaches the lift pressure of the outlet safety valve of secondary superheater 42 by about 25-30 psig. This can result in venting of an additional 5-10% BMCR steam through power operated vent valve 70.

If present, optional dribble pump 170 can maintain water flow to drum 20 to offset water lost through continued production, as well as venting, of steam. Commencement of flow can be manual or automatic, usually in less than 10 minutes and preferably within no more than 5 to 7 minutes, and preferably is capable of lasting for ~45 minutes from point of initiation. Dribble pump 170 preferably is capable of supplying drum 20 with at least 10% of maximum continuous rating (MCR) feed water flow at normal operation pressure and can keep the level of water in drum 20 stable at or within 7.5-10 cm (3 to 4 inches) below normal water level.

A more detailed description of these ameliorative measures can be found in the aforementioned U.S. Pat. No. 8,047,162.

In addition to the foregoing common post-trip events, the present equipment and processes transport some of steam 115 in steam discharge system 100 to eductor 57, with the flow of that steam being controlled by valve 58.

Steam discharge into furnace 10 through eductor 57 starts and valve 56 opens. Eductor 57 is a device that uses the kinetic energy of a moving fluid (in this case steam 115) to entrain another fluid (in this case ambient air). Suction created by eductor 57 induces ambient air flow into furnace 10 through opened valve 56. The mixed steam and air are discharged into furnace 10 through nozzle 50. Steam velocity may be of 500 ft/sec or 800 ft/sec or 1100 ft/sec.

Each nozzle of a furnace, or any lesser number, can be fit with an eductor and accompanying piping and valves.

The induced air flow rate not only adds to the discharge steam flow rate but, because ambient air temperature (~15° to ~35° C.) is substantially lower than that of steam (~150° to ~300° C.), the cooling capacity of the combined flow of steam and air into furnace 10 is substantially higher than that of the steam alone. This results in faster cooling of U-beam 32. Further, use of less steam in the cooling process means that the amount of extra capacity designed into drum 20 can be reduced and, depending on the efficacy of a given cooling arrangement, dribble pump 170 can be likewise downsized or even eliminated altogether.

Using ambient air for such cooling during abnormal operating conditions partially decouples steam discharge flow rate from the cooling needs. If more steam needs to be discharged for maintaining drum pressure than required for cooling needs (i.e., by inducing ambient air flow), additional steam discharge can be accomplished through remotely-controlled relief valve 70. Cooling steam discharge is expected to be on the order of ~3% to 10% of BMCR.

With the ID fan (not shown) idled due to abnormal operating (e.g., black plant) conditions, furnace 10 has positive pressure due to the pressure drop across the boiler convection pass generated by the combined cooling steam/air flow from eductor 57. To prevent combustible gases generated within the hot bed material on the floor of furnace 10 being forced through distribution grid 90 into windbox 80, the pressure in windbox 80 preferably is maintained higher than that in furnace 10, as evidenced by the outputs of pressure sensor 94 (in windbox 80) and of pressure sensor 96 (in furnace 10). Ensuring higher pressure in windbox 80 can be achieved by injecting steam 115 into windbox 80 through line 61, while maintaining valve 92 in a closed position. Steam flow rate through line 61 is controlled by valve 165 so as to maintain an acceptable preset pressure differential, again as evidenced by the relative outputs of pressure sensors 94 and 96. Flow rate of steam 115 through line 61 typically does not exceed 1.5%, 1%, or even 0.5% of BMCR.

A portion of steam injected into windbox 80 moves through distribution grid 90 while another portion condenses. The latter can be removed through windbox drain valve 82.

All venting to furnace 10, including that through eductor 57, can be ceased when temperature sensor 139 indicates that the local temperature has fallen to a preset temperature of, for example, ~540° C. (1000° F.), ~510° C. (950° F.), ~480° C. (900° F.) or even ~450° C. (850° F.).

The CFB boiler unit can be returned to normal operation configuration after power supply thereto is re-established.

The foregoing description has been made with reference to exemplary embodiments. While various aspects and embodiments have been disclosed herein, other aspects, embodiments, modifications and alterations will be apparent to those skilled in the art upon reading and understanding the preceding detailed description. The various aspects and embodiments disclosed herein are for purposes of illustration and are not intended to be limiting. It is intended that the present disclosure be construed as including all such aspects, embodiments, modifications and alterations insofar as they come within the scope of the appended claims or the equivalents thereof.

The relevant portion(s) of any specifically referenced patent and/or published patent application is/are incorporated herein by reference.

That which is claimed is:

1. In a circulating fluidized bed boiler arrangement that comprises a furnace with at least one primary air inlet and one or more secondary air inlets, a solids separator system, a steam/water circuit for circulating steam and water, and a steam discharge system, a system for cooling components of said boiler arrangement during abnormal operating conditions comprising:

a) at least one of said one or more secondary air inlets comprising a valve which, in an opened conditions, permits ingress of air external to said boiler arrangement;

b) conduit for conveying steam out of and away from the steam discharge circuit, said conduit providing ingress to said at least one secondary air inlet; and c) in or associated with said secondary air inlet, an eductor in communication with said steam conveyance conduit, said eductor being capable of outputting a combined stream of said external air and said conveyed steam to said furnace during abnormal operating conditions.

2. The system for cooling components of a boiler arrangement of claim 1 wherein said furnace further comprises a windbox beneath the floor of said furnace, said windbox being operationally connected to said steam discharge system.

3. The system for cooling components of a boiler arrangement of claim 2 wherein said furnace comprises a first sensor indicating the pressure in said furnace and wherein said windbox comprises a second sensor indicating the pressure in said windbox.

4. The system for cooling components of a boiler arrangement of claim 3 further comprising a valve to permit introduction of sufficient steam into said windbox to maintain a pre-determined pressure differential between said windbox and said furnace, as indicated by said first and second sensors.

5. The system for cooling components of a boiler arrangement of claim 2 wherein said windbox comprises a drain valve, said valve permitting egress of condensate that forms upon introduction of steam into said windbox.

6. The system for cooling components of a boiler arrangement of claim 1 wherein the steam discharge system comprises a main steam outlet connected to a vent for opening and releasing steam into the atmosphere to monitor the pressure at the main steam outlet.

7. The system for cooling components of a boiler arrangement of claim 6 wherein the steam discharge system comprises a dribble pump for maintaining water flow to a drum to offset water lost through continued production and/or venting of steam.

8. The system for cooling components of a boiler arrangement of claim 1 wherein the solids separator system comprises one or more U-beam impact-type separators to protect downstream heating surfaces from erosion; said separators further equipped with one or more temperature sensors for monitoring the temperature of said separators.

9. A method for facilitating the cooling of components of a circulating fluidized bed boiler arrangement that comprises (1) a furnace with at least one primary air inlet and one or more secondary air inlets, wherein at least one of said one or more secondary air inlets is adapted to communicate with an air valve and encloses an eductor, (2) a solids separator system and (3) a steam/water circuit for circulating steam and water, said method comprising:

a) conveying steam out of and away from said steam/water circuit to said eductor; and b) allowing said eductor to combine said steam with air introduced through said air valve, said air originating from a source external to said boiler arrangement; and c) introducing said combined stream into said furnace, thereby reducing the internal temperature of said furnace and helping to cool said components.

10. The method of claim 9 wherein said furnace further comprises a windbox beneath the floor of said furnace, said windbox being provided with a source of steam from said steam/water circuit.

11. The method of claim 10 further comprising monitoring the pressure in each of said furnace and said windbox.

12. The method of claim 11 wherein said furnace comprises a first sensor for indicating the pressure in said furnace and wherein said windbox comprises a second sensor for indicating the pressure in said windbox.

13. The method of claim 12 wherein said windbox comprises a valve that permits introduction of sufficient steam to maintain a predetermined pressure differential between said windbox and said furnace, as indicated by said first and second sensors.

14. The method of claim 13 wherein said windbox comprises a drain valve, said method further comprising allowing condensate that forms upon introduction of steam into said windbox to exit said windbox.

15. The method of claim 10 wherein said windbox comprises a valve that permits introduction of sufficient steam to maintain a predetermined pressure differential between said windbox and said furnace.

16. The method of claim 15 wherein said windbox comprises a drain valve, said method further comprising allowing condensate that forms upon introduction of steam into said windbox to exit said windbox.

17. The method of claim 9 wherein said steam introduced into the furnace is at a velocity in the range of ~500 ft/sec to ~1100 ft/sec; and wherein the cooling capacity of the combined stream into said furnace is substantially higher than that of the steam alone.

18. The method of claim 9 wherein the steam discharge system comprises a main steam outlet connected to relief valve; and wherein cooling steam discharge is on the order of ~3% to 10% of boiler maximum continuous rating.

19. The method of claim 9 wherein the steam discharge system comprises a dribble pump; and wherein said dribble pump is capable of supplying a drum with at least 10% of maximum continuous rating feed water flow at normal operation pressure and maintain the drum with a stable level of water.

20. The method of claim 9 wherein the solids separator system comprises one or more U-beam impact-type separators equipped with one or more temperature sensors; and said temperature of said separators are monitored through use of temperatures sensors to maintain a local temperature below a preset temperature.

* * * * *